US007624793B2

(12) United States Patent
Freyer et al.

(10) Patent No.: US 7,624,793 B2
(45) Date of Patent: Dec. 1, 2009

(54) METHOD AND APPARATUS FOR PERFORATING AND ISOLATING PERFORATIONS IN A WELLBORE

(75) Inventors: Rune Freyer, Stavanger (NO); Christopher J. Chalker, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 11/852,291

(22) Filed: Sep. 8, 2007

(65) Prior Publication Data

US 2008/0066912 A1 Mar. 20, 2008

(30) Foreign Application Priority Data

Sep. 12, 2006 (WO) ..... PCT/US2006/035304

(51) Int. Cl.
*E21B 43/11* (2006.01)

(52) U.S. Cl. ..... 166/55; 166/191

(58) Field of Classification Search ..... 166/297, 166/387, 55, 191
See application file for complete search history.

(56) References Cited

U.S. PATENT DOCUMENTS

| | | | | |
|---|---|---|---|---|
| 3,385,367 | A | 5/1968 | Kollsman | |
| 5,165,274 | A * | 11/1992 | Thiercelin | 73/152.59 |
| 5,174,379 | A * | 12/1992 | Whiteley et al. | 166/278 |
| 5,287,741 | A | 2/1994 | Schultz et al. | |
| 5,704,426 | A | 1/1998 | Rytlewski et al. | |
| 5,829,538 | A | 11/1998 | Wesson et al. | |
| 6,062,310 | A | 5/2000 | Wesson et al. | |
| 7,059,415 | B2 | 6/2006 | Bosma et al. | |
| 7,478,676 | B2 | 1/2009 | East, Jr. et al. | |
| 2002/0017387 | A1 * | 2/2002 | Ringgenberg et al. | 166/250.17 |
| 2003/0066643 | A1 | 4/2003 | Ringgenberg et al. | |
| 2003/0141064 | A1 * | 7/2003 | Roberson, Jr. | 166/300 |
| 2004/0020662 | A1 | 2/2004 | Freyer | |
| 2006/0180320 | A1 | 8/2006 | Hilsman et al. | |
| 2007/0257405 | A1 | 11/2007 | Freyer | |

FOREIGN PATENT DOCUMENTS

WO 2005/116394 12/2005

OTHER PUBLICATIONS

International Search Report and Written Opinion issued for International Application No. PCT/US06/35304 dated Feb. 25, 2008 (7 pages).
International Preliminary Report on Patentability and Written Opinion issued Apr. 2, 2009, for International Patent Application Serial No. PCT/US06/35304, 5 pages.

* cited by examiner

*Primary Examiner*—Jennifer H Gay
*Assistant Examiner*—Daniel P Stephenson
(74) *Attorney, Agent, or Firm*—Marlin R. Smith

(57) ABSTRACT

A method and apparatus for perforating and isolating perforations in a wellbore. A perforating and isolating apparatus includes at least one packer having a swellable seal material, and a perforating assembly attached to the packer. A method of perforating and isolating perforations in a subterranean wellbore includes the steps of: positioning an apparatus in the wellbore, the apparatus including at least one packer having a swellable seal material, and a perforating assembly attached to the packer; isolating at least one existing perforation by swelling the seal material; and forming at least one new perforation by actuating the perforating assembly.

15 Claims, 3 Drawing Sheets

METHOD AND APPARATUS FOR PERFORATING AND ISOLATING PERFORATIONS IN A WELLBORE

CROSS-REFERENCE TO RELATED APPLICATION

The present application claims the benefit under 35 USC §§119 and 365 of the filing date of International Application No. PCT/US2006/035304, filed Sep. 12, 2006. The entire disclosure of this prior application is incorporated herein by this reference.

BACKGROUND

The present invention relates generally to equipment utilized and operations performed in conjunction with a subterranean well and, in an embodiment described herein, more particularly provides a method and apparatus for perforating and isolating perforations in a wellbore.

Occasionally it is desired to perforate one or more zones in a well after one or more other zones have already been perforated. The previously perforated zone(s) would be isolated, allowing production or injection to proceed via the newly perforated zone(s).

Typically, this would be accomplished by conveying perforating guns into the well to perforate the additional zones, and then conveying straddle packers into the well to isolate the originally perforated zones. It will be appreciated that this method requires multiple trips into the well, requires that the straddle packers be conveyed into the well and set after perforating debris has been introduced into the well, and allows cross-flow between the originally perforated zones and the newly perforated zones in the time between when the perforating guns are detonated and when the straddle packers are set. This cross-flow may be an environmental hazard or at least a waste of valuable resources.

Therefore, it may be seen that improvements are needed in the art of well perforating and isolation.

SUMMARY

In carrying out the principles of the present invention, methods and apparatus are provided which solve at least one problem in the art. One example is described below in which old perforations are isolated and new perforations are formed in a single trip into a wellbore. Another example is described below in which straddle packers attached to a perforating gun are constructed using swellable seal material.

In one aspect of the invention, a perforating and isolating apparatus is provided for use in a subterranean wellbore. The apparatus includes at least one packer having a swellable seal material, and a perforating assembly attached to the packer.

In another aspect of the invention, a method of perforating and isolating perforations in a wellbore includes the steps of: positioning an apparatus in the wellbore, the apparatus including at least one packer having a swellable seal material, and a perforating assembly attached to the packer; isolating at least one existing perforation by swelling the seal material; and forming at least one new perforation by actuating the perforating assembly.

The positioning step may be performed in a single trip into the wellbore. The isolating step is preferably performed prior to the perforation forming step. The forming step may be performed while preventing cross-flow between the existing perforation and the new perforation.

The at least one perforating assembly may include multiple perforating assemblies, and the packer may be positioned between the perforating assemblies.

Multiple packers may be separated by a structure. Fluid communication may be permitted through the structure between the packers.

The isolating step may include swelling the seal material of the packers straddling the existing perforation. The step of swelling the seal material may include exposing the seal material to a well fluid (e.g., water, hydrocarbon liquid, gas, etc.) in the well.

The perforating assembly may be attached opposite one of the packers from the structure. If there are multiple perforating assemblies, one perforating assembly may be attached opposite one of the packers from the structure, and another perforating assembly may be attached opposite another packer from the structure.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
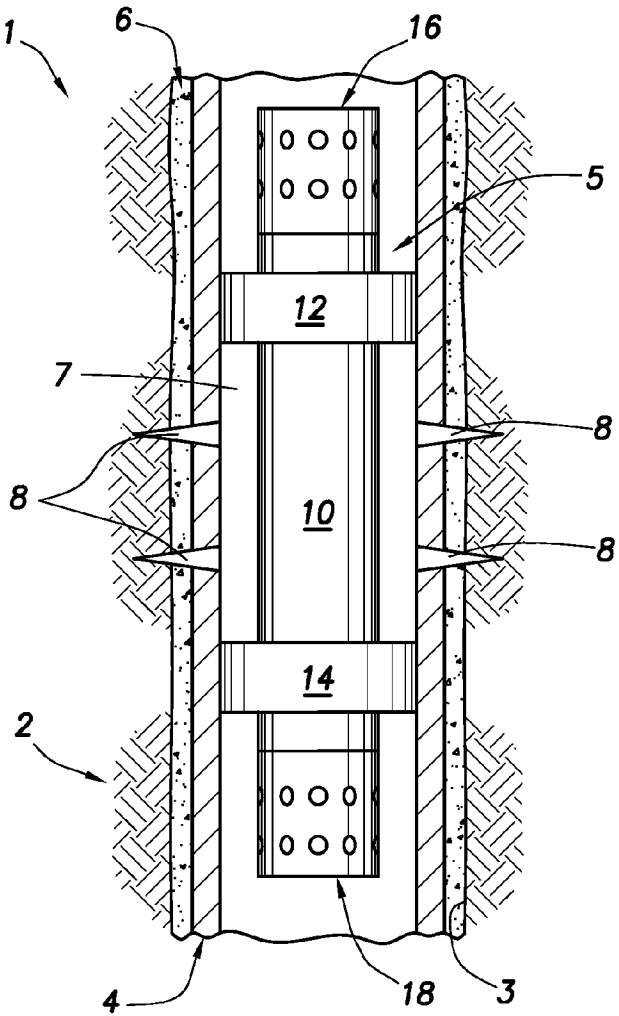
FIG. 1 is a schematic partially cross-sectional view of a well system and associated method embodying principles of the present invention, wherein packers have been set in a cased wellbore.

Representatively illustrated in FIG. 1 is a well system 1 and associated method which embody principles of the present invention. In the well system 1, an earth formation 2 is penetrated by a wellbore 3 which is preferably lined with a tubular string 4. The tubular string 4 may be of the type known to those skilled in the art as casing or liner, whether continuous or segmented. However, it should be understood that the tubular string 4 could be made of any material or construction, and the wellbore 3 could be lined in other ways (for example, using cement 6 or other isolating materials), in keeping with the principles of the invention.

Perforations 8 have previously been formed through the tubular string 4 and cement 6 to thereby allow fluid communication between the formation 2 and the interior of the tubular string. It is now desired to form new perforations (for example, into other zones of the formation 2) and to isolate the existing perforations 8.

For this purpose, a perforating and isolating apparatus 5 is conveyed into the tubular string 4. The apparatus 5 may be conveyed into the tubular string 4 in any manner, for example, on wireline or slickline, on coiled tubing, on production tubing, on drill pipe, etc.

The apparatus 5 includes annular barriers or packers 12, 14 spaced apart on a generally tubular structure 10. The structure 10 could, for example, be made up of one or more sections of tubing if fluid communication through the structure is desired. Alternatively, the structure 10 could be non-tubular if such fluid communication is not desired.

The packers 12, 14 are used to seal off an annulus 7 formed radially between the structure 10 and the tubular string 4. Preferably, the packers 12, 14 include a swellable seal material. In this manner, the packers 12, 14 can be expanded radially outward to seal against the tubular string 4 without use of complex and potentially failure-prone downhole mechanisms.

The term "swell" and similar terms (such as "swellable") are used herein to indicate an increase in volume of a seal material. Typically, this increase in volume is due to incorporation of molecular components of the well fluid into the seal material itself, but other swelling mechanisms or techniques may be used, if desired.

Note that swelling is not the same as expanding, although a seal material may expand as a result of swelling. For example, in conventional packers, a seal element may be expanded radially outward by longitudinally compressing the seal element, or by inflating the seal element. In each of these cases, the seal element is expanded without any increase in volume of the seal material of which the seal element is made.

Various techniques may be used for contacting the swellable seal material with appropriate well fluid for causing swelling of the seal material. The well fluid may already be present in the well when the packers 12, 14 are installed in the well, in which case the seal assemblies of the packers preferably include features (such as absorption delaying coatings or membranes, swelling delayed material compositions, etc.) for delaying the swelling of the seal material.

Alternatively, the well fluid which causes swelling of the seal material may be circulated through the well to the packers 12, 14 after the packers are in the well. As another alternative, the well fluid which causes swelling of the seal material may be produced into the wellbore 3 from the formation 2 surrounding the wellbore. Thus, it will be appreciated that any method may be used for causing swelling of the seal material of the packers 12, 14 in keeping with the principles of the invention.

The well fluid which causes swelling of the seal material could be water and/or hydrocarbon fluid (including liquid and/or gas). For example, water or hydrocarbon fluid produced from the formation 2 surrounding the wellbore 3 could cause the seal material to swell.

Various seal materials are known to those skilled in the art, which seal materials swell when contacted with water and/or hydrocarbon fluid, so a comprehensive list of these materials will not be presented here. Partial lists of swellable seal materials may be found in U.S. Pat. Nos. 3,385,367 and 7,059,415, in U.S. Published Application No. 2004-0020662, and in International Application No. PCT/NO2005/000170 (published as WO2005/116394), the entire disclosures of which are incorporated herein by this reference. However, it should be understood that any seal material which swells downhole or when contacted by any type of well fluid (including liquid and/or gas) may be used in keeping with the principles of the invention.

For example, in the International Application No. PCT/NO2005/000170 referenced above, a method and a device for expanding a body under overpressure is described, in which the body is formed of a material with a considerable portion of cavities. The body is compressed when being placed in an area of overpressure, and is expanded in a well by the cavities filling with fluid. An annular seal may be created by the expansion of rubber foam, by diffusion of fluid into the closed cell rubber foam.

As depicted in FIG. 1, the seal material of the packers 12, 14 has swollen, so that the packers now sealingly engage the interior surface of the tubular string 4. The perforations 8 are now isolated.

Connected at either end of the apparatus 5 are perforating assemblies 16, 18. Each of the perforating assemblies 16, 18 may include one or more perforating guns and firing mechanisms for detonating the perforating guns. Any suitable perforating assemblies may be used for the perforating assemblies 16, 18. For example, suitable perforating assemblies are described in U.S. Pat. Nos. 6,062,310 and 5,829,538, the entire disclosures of which are incorporated herein by this reference.

The firing mechanisms for the perforating assemblies 16, 18 may be actuated using any suitable means. For example, mechanical, hydraulic, pressure pulse, acoustic telemetry, electromagnetic telemetry, or any other means or combination thereof may be used to actuate the firing mechanisms in keeping with the principles of the invention.

Although one perforating assembly 16 is depicted in FIG. 1 above the upper packer 12, with another perforating assembly 18 depicted below the lower packer 14 and the structure 10 between the packers, it should be understood that this particular arrangement is not necessary, and any combination of numbers and positions of perforating assemblies, structures and packers may be used in keeping with the principles of the invention. For example, a single long packer could be used to isolate the perforations 8 instead of the two packers 12, 14, in which case the structure 10 may not be used. As another example, only a single perforating assembly may be used to perforate a single zone above or below the isolated perforations 8, instead of the multiple perforating assemblies 16, 18. Thus, it should be clearly understood that the well system 1 and apparatus 5 are only used here to demonstrate an example of how the principles of the invention may be used in a particular application, but the invention is not limited at all to the details of this specific example.

Figure 2:
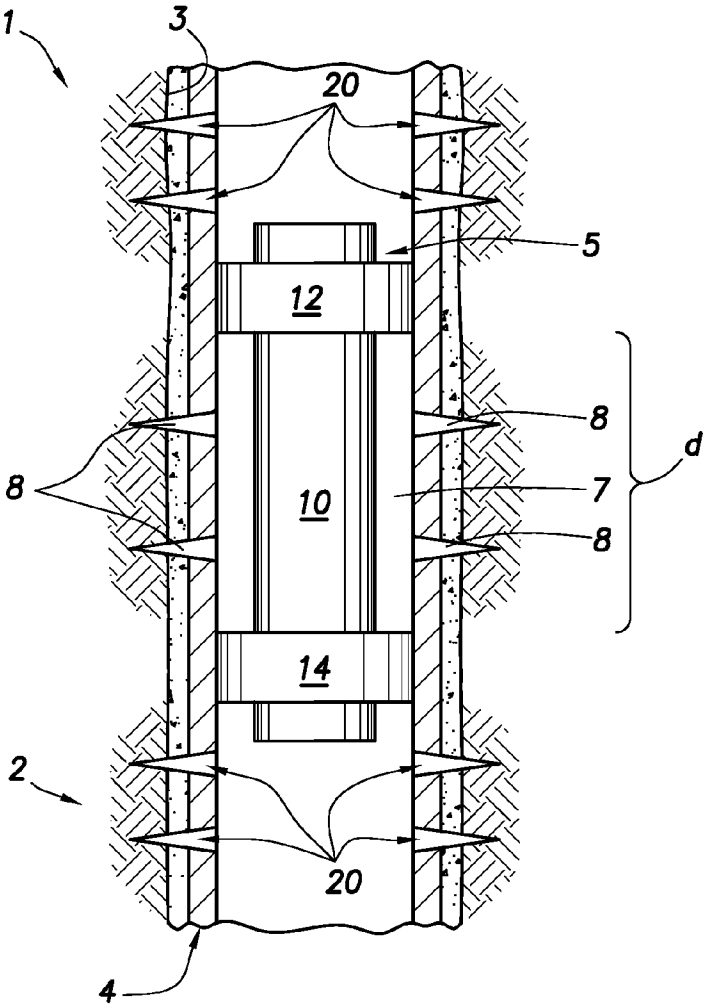
FIG. 2 is a schematic partially cross-sectional view of the well system of FIG. 1, wherein new perforations have been formed.

Referring additionally now to FIG. 2, the well system 1 is representatively illustrated after the perforating assemblies 16, 18 have been actuated to form additional perforations 20 above the upper packer 12 and below the lower packer 14. In this example, the perforating assemblies 16, 18 are of the type which disintegrate upon detonation, and so the perforating assemblies are not shown in FIG. 2. Other types of perforating assemblies 16, 18 may be used in keeping with the principles of the invention.

In cases where a perforating assembly (such as the perforating assembly 18) is positioned below a packer, it is preferred that the perforating assembly permit fluid communication at least after the perforating assembly has been detonated or actuated. For example, the perforating assembly could disintegrate, it could be detached from the remainder of the apparatus 5 so that it no longer blocks fluid communication, it could provide a fluid passage after detonation (as described in the incorporated U.S. Pat. Nos. 6,062,310 and 5,829,538), etc.

As depicted in FIG. 2, the objectives of the method have been accomplished, since the existing perforations 8 have been isolated and the new perforations 20 have been formed above and below the perforations 8. Note that the packers 12, 14 are separated by a distance d using the structure 10, with the structure also providing fluid communication between the interior of the tubular string 4 above the upper packer 12 and the interior of the tubular string below the lower packer 14.

Note that the objectives of the method have been accomplished without using complex and failure-prone mechanical packer setting mechanisms, without allowing cross-flow between the existing perforations 8 and the new perforations 20, without conveying or setting packers after perforating debris is introduced into the tubular string 4, and requiring only a single trip into the well to convey the apparatus 5 into the tubular string.

Figure 5:
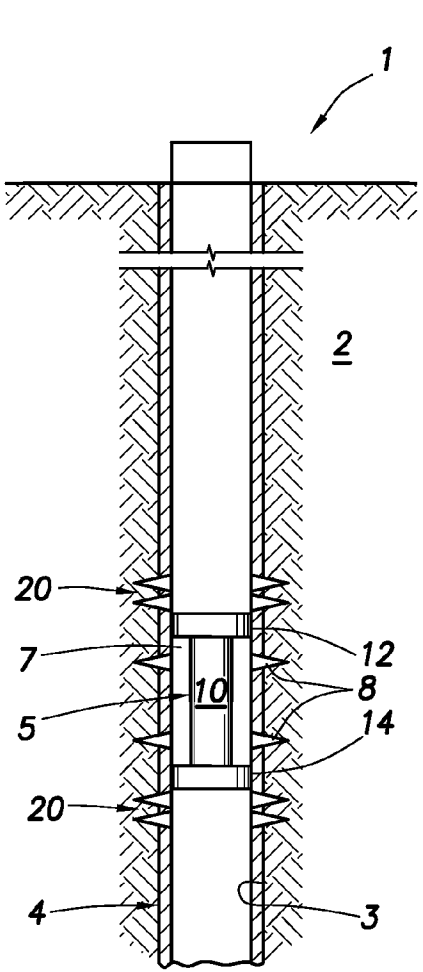
FIG. 5 is a schematic partially cross-sectional view of subsequent steps in the method, wherein additional zones have been perforated.
Figure 4:
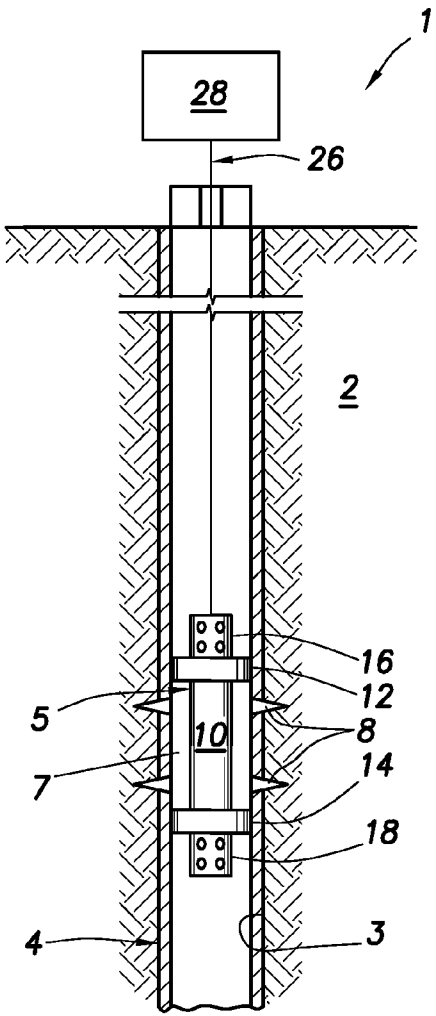
FIG. 4 is a schematic partially cross-sectional view of subsequent steps in the method, wherein packers are set.
Figure 3:
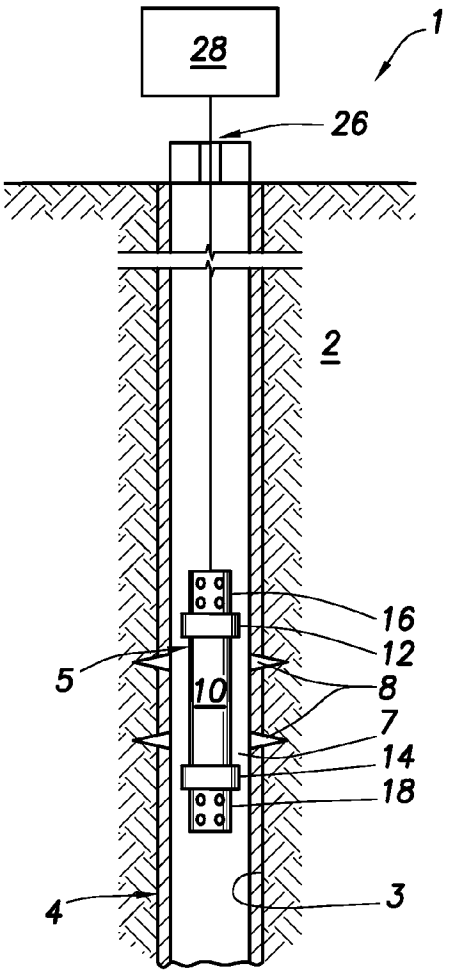
FIG. 3 is a schematic partially cross-sectional view of initial steps of installing a perforating and isolating apparatus in the method of FIG. 1.

Referring additionally now to FIGS. 3-5, various steps in the method of isolating the existing perforations 8 and forming the new perforations 20 are representatively and schematically illustrated. In FIG. 3, the apparatus 5 is conveyed into the tubular string 4.

A conveyance 26 used to position and secure the apparatus 5 in the tubular string 4 may be a tubing string, wireline, slickline, drill pipe, or any other type of conveyance. A control device 28 (such as a coiled tubing injector, wireline or slickline rig, workover or drilling rig, etc.) is used to control the conveyance 26.

As depicted in FIG. 3, the packers 12, 14 have not yet been set. The swellable seal material of the packers 12, 14 may or may not have been contacted with the well fluid which causes the seal material to swell.

In FIG. 4, the packers 12, 14 have been set. The packers 12, 14 now seal off the annulus 7 and thereby isolate the existing perforations 8. Contact between the packers 12, 14 and the interior of the tubular string 4 may also serve to secure the apparatus 5 in the tubular string, in which case a separate anchoring device may not be provided. However, an anchoring device could be used in keeping with the principles of the invention.

In FIG. 5, the perforating assemblies 16, 18 have been detonated, thereby forming the new perforations 20 above and below the packers 12, 14. The perforating assemblies 16, 18 are no longer attached to the apparatus 5, but it should be understood that one or both of the perforating assemblies could remain attached to the apparatus in other embodiments.

The apparatus 5 is also no longer attached to the conveyance 26. However, the conveyance 26 could remain attached to the apparatus 5 in other embodiments.

Figure 6:
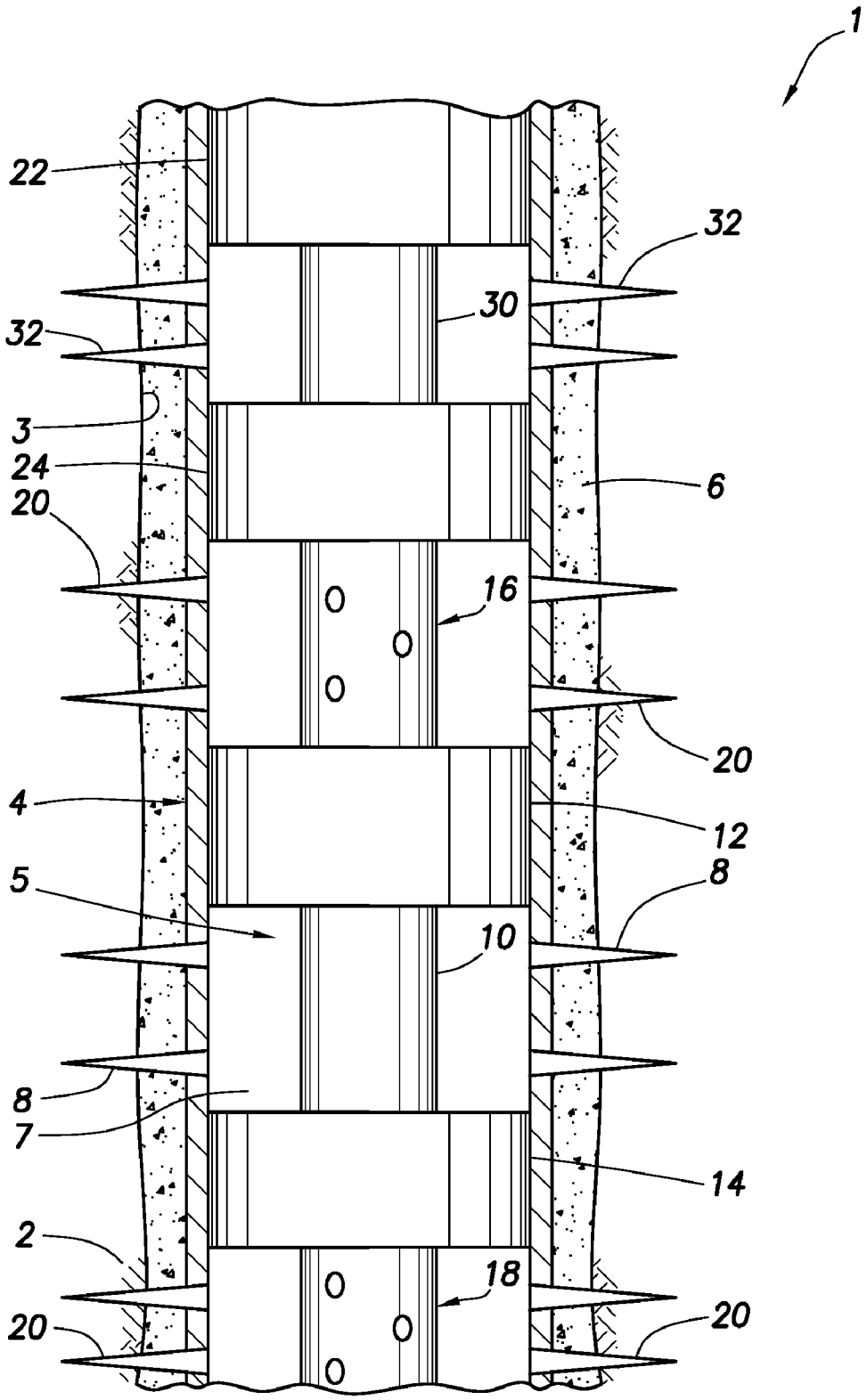
FIG. 6 is a schematic partially cross-sectional view of an alternate embodiment of the well system and method.

Referring additionally now to FIG. 6, an alternate embodiment of the well system 1 and associated method is representatively and schematically illustrated. In this embodiment, the apparatus 5 includes additional packers 22, 24 to isolate additional existing perforations 32. An additional generally tubular structure 30 is used to space apart the packers 22, 24. The structure 30 and the packers 22, 24 may be similar to the structure 10 and packers 12, 14 described above.

The embodiment of FIG. 6 demonstrates that any number of the elements, and any configuration of the elements, of the apparatus 5 may be used. The apparatus 5 may include elements in addition to those described herein, or the apparatus may include fewer elements than those described herein. Any number and positioning of existing perforations may be isolated, and any number and positioning of new perforations may be formed. Although the packers 12, 14, 22, 24 are depicted in FIG. 6 as separating alternating structures 10, 30 and perforating assemblies 16, 18, this configuration is not necessary in keeping with the principles of the invention.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method of perforating and isolating in a subterranean wellbore, the method comprising the steps of:

positioning an apparatus in the wellbore, the apparatus including first and second packers, each having a swellable seal material, and a perforating assembly attached to the first and second packers;

isolating at least one existing perforation by swelling the seal material of each of the first and second packers;

forming multiple new perforations by actuating the perforating assembly, wherein fluid communication is not allowable between the at least one existing perforation and the new perforations; and providing fluid communication between the new perforations on opposite longitudinal sides of the apparatus while fluid communication is not allowable between the at least one existing perforation and the new perforations, the fluid communication being provided longitudinally through a tubular structure interconnecting and spacing apart the first and second packers.

2. The method of claim 1, wherein the positioning step is performed in a single trip into the wellbore.

3. The method of claim 1, wherein all of the positioning, isolating and forming steps are performed in a single trip into the wellbore.

4. The method of claim 1, wherein the isolating step is performed prior to the perforating forming step.

5. The method of claim 1, wherein the forming step is performed while preventing cross-flow between the existing perforation and the new perforation.

6. The method of claim 1, wherein the isolating step further comprises swelling the seal material of each of the first and second packers straddling the existing perforation.

7. The method of claim 6, wherein in the positioning step the perforating assembly is attached opposite one of the first and second packers from the structure.

8. The method of claim 6, wherein in the positioning step the at least one perforating assembly includes first and second perforating assemblies, and wherein the first perforating assembly is attached opposite the first packer from the structure, and the second perforating assembly is attached opposite the second packer from the structure.

9. The method of claim 1, wherein in the positioning step the at least one perforating assembly includes first and second perforating assemblies, and wherein the first and second packers are positioned between the first and second perforating assemblies.

10. The method of claim 1, wherein the step of swelling the seal material further comprises exposing the seal material to a well fluid in the well.

11. A perforating and isolating apparatus for use in a subterranean wellbore, the apparatus comprising:

at least first and second packers, each having a swellable seal material; and a perforating assembly attached to at least one of the first and second packers, wherein the first and second packers are simultaneously interconnected to and spaced apart by a generally tubular structure, and wherein fluid communication is not allowable through a sidewall of the structure, but fluid communication is permitted longitudinally through the structure while fluid communication through the sidewall of the structure is prevented.

12. The apparatus of claim 10, wherein the perforating assembly is attached opposite one of the first and second packers from the structure.

13. The apparatus of claim 10, wherein the at least one perforating assembly includes first and second perforating assemblies, and wherein the first perforating assembly is attached opposite the first packer from the structure, and the second perforating assembly is attached opposite the second packer from the structure.

14. The apparatus of claim 10, wherein the at least one perforating assembly includes first and second perforating assemblies, and wherein the first and second packers are positioned between the first and second perforating assemblies.

15. The apparatus of claim 10, wherein the seal material is swellable in response to contact with a well fluid.

* * * * *